US008322318B2

(12) United States Patent
David et al.

(10) Patent No.: US 8,322,318 B2
(45) Date of Patent: Dec. 4, 2012

(54) HARMONIC DRIVE CAMSHAFT PHASER WITH PHASE AUTHORITY STOPS

(75) Inventors: Pascal David, Luxembourg (FR); Pierre Kimus, Attert (BE); Michael J. Fox, Stafford, NY (US)

(73) Assignee: Delphi Technologies, Inc., Troy, MI (US)

( * ) Notice: Subject to any disclaimer, the term of this patent is extended or adjusted under 35 U.S.C. 154(b) by 300 days.

(21) Appl. No.: 12/844,918

(22) Filed: Jul. 28, 2010

(65) Prior Publication Data

US 2012/0024247 A1 Feb. 2, 2012

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 5,417,186 | A | 5/1995 | Elrod et al. | |
| 6,328,006 | B1 | 12/2001 | Heer | |
| 7,421,990 | B2 | 9/2008 | Taye et al. | |
| 2008/0210182 | A1 * | 9/2008 | Schaefer et al. | 123/90.17 |

OTHER PUBLICATIONS

U.S. Appl. No. 12/536,575, filed Aug. 6, 2009.
U.S. Appl. No. 12/825,806, filed Jun. 29, 2010.
U.S. Appl. No. 61/253,982, filed Oct. 22, 2009.
U.S. Appl. No. 61/333,775, filed May 12, 2010.

* cited by examiner

*Primary Examiner* — Zelalem Eshete
(74) *Attorney, Agent, or Firm* — Thomas N. Twomey

(57) ABSTRACT

A camshaft phaser includes a housing with a harmonic gear drive unit disposed therein. The harmonic gear drive unit includes a circular spline and a dynamic spline, a flexspline disposed radially within the circular spline and the dynamic spline, a wave generator disposed radially within the flexspline, and a rotational actuator connectable to the wave generator. One of the circular spline and the dynamic spline is fixed to the housing. A hub is rotatably disposed radially within the housing and attachable to the camshaft and fixed to the other of the circular spline and the dynamic spline. A first arcuate input stop member is rotatable with one of the circular spline and the dynamic spline and is received within a first arcuate output opening defined by at least a first arcuate output stop member rotatable with the other of the circular spline and the dynamic spline.

25 Claims, 7 Drawing Sheets

HARMONIC DRIVE CAMSHAFT PHASER WITH PHASE AUTHORITY STOPS

TECHNICAL FIELD OF INVENTION

The present invention relates to an electric variable cam phaser (eVCP) which uses an electric motor and a harmonic drive unit to vary the phase relationship between a crankshaft and a camshaft in an internal combustion engine; more particularly, to an eVCP with phase authority stops which limit the phase authority of the eVCP.

BACKGROUND OF INVENTION

Camshaft phasers ("cam phasers") for varying the timing of combustion valves in internal combustion engines are well known. A first element, known generally as a sprocket element, is driven by a chain, belt, or gearing from an engine's crankshaft. A second element, known generally as a camshaft plate, is mounted to the end of an engine's camshaft. A common type of camshaft phaser used by motor vehicle manufactures is known as a vane-type cam phaser. U.S. Pat. No. 7,421,989 shows a typical vane-type cam phaser which generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve, in accordance with an engine control module, to either the advance or retard chambers, to change the angular position of the rotor relative to the stator, as required to meet current or anticipated engine operating conditions. In prior art cam phasers, the rotational range of phaser authority is typically about 50 degrees of camshaft rotation; that is, from a piston top-dead-center (TDC) position, the valve timing may be advanced to a maximum of about −40 degrees and retarded to a maximum of about +10 degrees. The phase authority of a vane-type cam phaser is inherently limited by the vanes of the rotor which will contact the lobes of the stator. Limiting the phase authority is important to prevent over-advancing and over-retarding which may, for example, result in undesired engine operation and engine damage due to interference of the engine valves and pistons.

While vane-type cam phasers are effective and relatively inexpensive, they do suffer from drawbacks. First, at low engine speeds, oil pressure tends to be low, and sometimes unacceptable. Therefore, the response of a vane-type cam phaser may be slow at low engine speeds. Second, at low environmental temperatures, and especially at engine start-up, engine oil displays a relatively high viscosity and is more difficult to pump, therefore making it more difficult to quickly supply engine oil to the vane-type cam phaser. Third, using engine oil to drive the vane-type cam phaser is parasitic on the engine oil system and can lead to requirement of a larger oil pump. Fourth, for fast actuation, a larger engine oil pump may be necessary, resulting in additional fuel consumption by the engine. Lastly, the total amount of phase authority provided by vane-type cam phasers is limited by the amount of space between adjacent vanes and lobes. A greater amount of phase authority may be desired than is capable of being provided between adjacent vanes and lobes. For at least these reasons, the automotive industry is developing electrically driven cam phasers.

One type of electrically driven cam phaser being developed is shown in U.S. patent application Ser. No. 12/536,575; U.S. patent application Ser. No. 12/825,806; U.S. Provisional Patent Application Ser. No. 61/253,982; and U.S. Provisional Patent Application Ser. No. 61/333,775; which are commonly owned by Applicant and incorporated herein by reference in their entirety. The electrically driven cam phaser is an electric variable cam phaser (eVCP) which comprises a flat harmonic drive unit having a circular spline and a dynamic spline linked by a common flexspline within the circular and dynamic splines, and a single wave generator disposed within the flexspline. The circular spline is connectable to either of an engine camshaft or an engine crankshaft driven rotationally and fixed to a housing, the dynamic spline being connectable to the other thereof. The wave generator is driven selectively by an electric motor to cause the dynamic spline to rotate past the circular spline, thereby changing the phase relationship between the crankshaft and the camshaft. Unlike vane-type cam phasers in which the phase authority is inherently limited by interaction of the rotor and stator, there is no inherent limitation of the phase authority of the eVCP. The eVCP is also capable of provide a phase authority of 100 degrees or even more if desired for a particular engine application.

U.S. Pat. No. 7,421,990 discloses an eVCP comprising a harmonic drive unit. The eVCP of this example uses a phase range limiter that is bolted to the camshaft. The phase range limiter protrudes through an arcuate slot formed in a sprocket wheel. The two ends of the arcuate slot constrain movement of the phase range limiter and thereby limit phase authority of the eVCP. However, this arrangement for limiting the phase authority of the eVCP requires additional components and assembly time. Additionally, since the phase range limiter is external to the eVCP, it may be susceptible to damage which would affect the phase authority of the eVCP.

What is needed is an eVCP with means for limiting the phase authority of the eVCP. What is also needed is a robust means for limiting the phase authority of the eVCP which does not require the addition of components to the eVCP.

SUMMARY OF THE INVENTION

Briefly described, a camshaft phaser is provided for controllably varying the phase relationship between a crankshaft and a camshaft in an internal combustion engine. The camshaft phaser includes a housing having a bore with a longitudinal axis and a harmonic gear drive unit is disposed therein. The harmonic gear drive unit includes a circular spline and a dynamic spline, a flexspline disposed radially within the circular spline and the dynamic spline, a wave generator disposed radially within the flexspline, and a rotational actuator connectable to the wave generator. One of the circular spline and the dynamic spline is fixed to the housing in order to prevent relative rotation therebetween. A hub is rotatably disposed within the housing and attachable to the camshaft and fixed to the other of the circular spline and the dynamic spline in order to prevent relative rotation therebetween. A first arcuate input stop member is provided having a first length and rotatable with one of the circular spline and the dynamic spline. A first arcuate output opening having a second length is defined by at least a first arcuate output stop member having a third length. The first arcuate output opening and the first arcuate output stop member are rotatable with the other of the circular spline and the dynamic spline. The first arcuate input stop member is received within the first arcuate output opening and the first length of the first arcuate input stop member is less than the second length of the first arcuate output opening to establish a predetermined phase authority of the camshaft phaser. An anti-rotation means is provided for temporarily fixing the circular spline to the dynamic spline in order to prevent relative rotation therebetween when the hub is being attached to the camshaft.

BRIEF DESCRIPTION OF DRAWINGS

This invention will be further described with reference to the accompanying drawings in which.

DETAILED DESCRIPTION OF INVENTION

Figure 1:
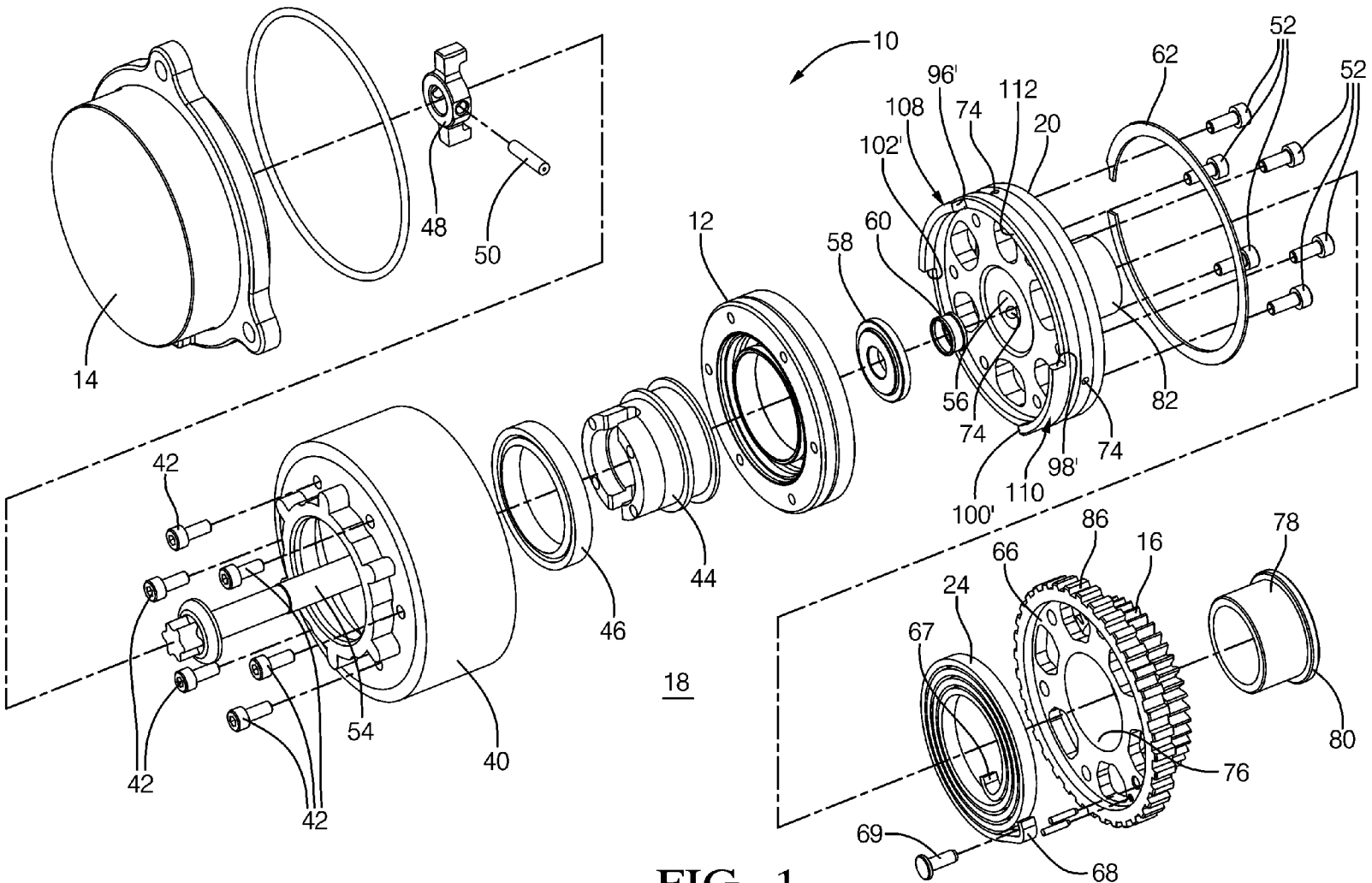
FIG. 1 is an exploded isometric view of an eVCP in accordance with the present invention.
Figure 2:
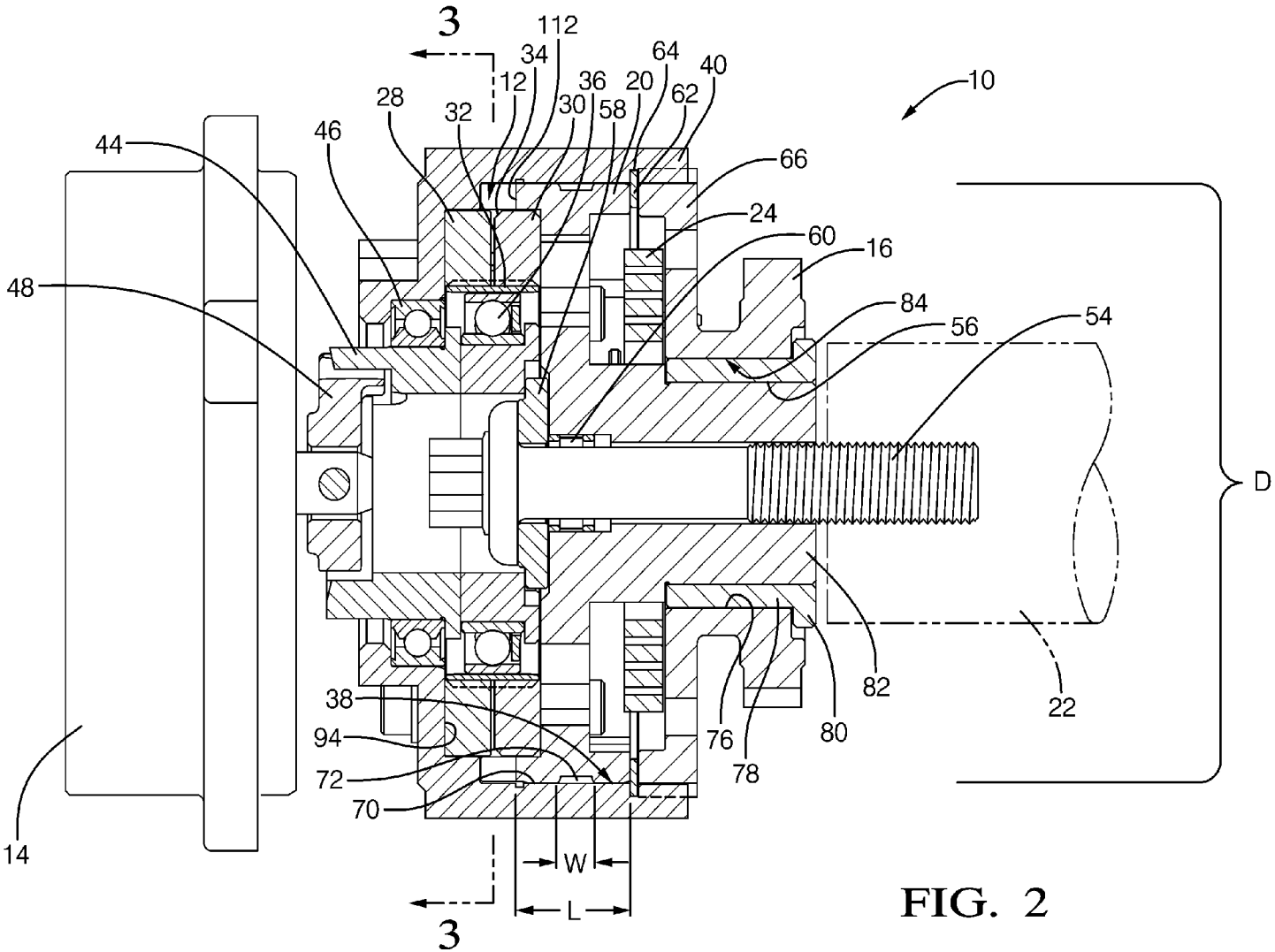
FIG. 2 is an axial cross-section of an eVCP in accordance with the present invention.

Referring to FIGS. 1 and 2, an eVCP 10 in accordance with the present invention comprises a flat harmonic gear drive unit 12; a rotational actuator 14 that may be a hydraulic motor but is preferably a DC electric motor, operationally connected to harmonic gear drive unit 12; an input sprocket 16 operationally connected to harmonic gear drive unit 12 and drivable by a crankshaft (not shown) of engine 18; an output hub 20 attached to harmonic gear drive unit 12 and mountable to an end of an engine camshaft 22; and a bias spring 24 operationally disposed between output hub 20 and input sprocket 16. Electric motor 14 may be an axial-flux DC motor.

Harmonic gear drive unit 12 comprises an outer first spline 28 which may be either a circular spline or a dynamic spline as described below; an outer second spline 30 which is the opposite (dynamic or circular) of first spline 28 and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32.

Flexspline 32 is a non-rigid ring with external teeth on a slightly smaller pitch diameter than the circular spline. It is fitted over and elastically deflected by wave generator 36.

The circular spline is a rigid ring with internal teeth engaging the teeth of flexspline 32 across the major axis of wave generator 36. The circular spline serves as the input member.

The dynamic spline is a rigid ring having internal teeth of the same number as flexspline 32. It rotates together with flexspline 32 and serves as the output member. Either the dynamic spline or the circular spline may be identified by a chamfered corner 34 at its outside diameter to distinguish one spline from the other.

As is disclosed in the prior art, wave generator 36 is an assembly of an elliptical steel disc supporting an elliptical bearing, the combination defining a wave generator plug. A flexible bearing retainer surrounds the elliptical bearing and engages flexspline 32. Rotation of the wave generator plug causes a rotational wave to be generated in flexspline 32 (actually two waves 180° apart, corresponding to opposite ends of the major ellipse axis of the disc).

During assembly of harmonic gear drive unit 12, flexspline teeth engage both circular spline teeth and dynamic spline teeth along and near the major elliptical axis of the wave generator. The dynamic spline has the same number of teeth as the flexspline, so rotation of the wave generator causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator). Harmonic gear drive unit 12 is thus a high-ratio gear transmission; that is, the angular phase relationship between first spline 28 and second spline 30 changes by 2% for every revolution of wave generator 36.

Of course, as will be obvious to those skilled in the art, the circular spline rather may have slightly more teeth than the dynamic spline has, in which case the rotational relationships described below are reversed.

Still referring to FIGS. 1 and 2, input sprocket 16 is fixed to a generally cup-shaped sprocket housing 40 that is fastened by bolts 42 to first spline 28 in order to prevent relative rotation therebetween. Coupling adaptor 44 is mounted to wave generator 36 and extends through sprocket housing 40, being supported by bearing 46 mounted in sprocket housing 40. Coupling adapter 44 may be made of two separate pieces that are joined together as shown in FIG. 2. Coupling 48 mounted to the motor shaft of electric motor 14 and pinned thereto by pin 50 engages coupling adaptor 44, permitting wave generator 36 to be rotationally driven by electric motor 14, as may be desired to alter the phase relationship between first spline 28 and second spline 30.

Output hub 20 is fastened to second spline 30 by bolts 52 and may be secured to engine camshaft 22 by central through-bolt 54 extending through output hub axial bore 56 in output hub 20, and capturing stepped thrust washer 58 and filter 60 recessed in output hub 20. In an eVCP, it is necessary to limit radial run-out between the input hub and output hub. In the prior art, this has been done by providing multiple roller bearings to maintain concentricity between the input and output hubs. Referring to FIG. 2, radial run-out is limited by a single journal bearing interface 38 between sprocket housing 40 (input hub) and output hub 20, thereby reducing the overall axial length of eVCP 10 and its cost to manufacture. Output hub 20 is retained within sprocket housing 40 by snap ring 62 disposed in an annular groove 64 formed in sprocket housing 40.

Back plate 66, which is integrally formed with input sprocket 16, captures bias spring 24 against output hub 20. Inner spring tang 67 is engaged by output hub 20, and outer spring tang 68 is attached to back plate 66 by pin 69. In the event of an electric motor malfunction, bias spring 24 is biased to back-drive harmonic gear drive unit 12 without help from electric motor 14 to a rotational position of second spline 30 wherein engine 18 will start or run, which position may be at one of the extreme ends of the range of authority or intermediate of the phaser's extreme ends of its rotational range of authority. For example, the rotational range of travel in which bias spring 24 biases harmonic gear drive unit 12 may be limited to something short of the end stop position of the phaser's range of authority. Such an arrangement would be useful for engines requiring an intermediate park position for idle or restart.

The nominal diameter of output hub 20 is D; the nominal axial length of first journal bearing 70 is L; and the nominal axial length of the oil groove 72 formed in either output hub 20 (shown) and/or in sprocket housing 40 (not shown) for supplying oil to first journal bearing 70 is W. In addition to journal bearing clearance, the length L of the journal bearing in relation to output hub diameter D controls how much output hub 20 can tip within sprocket housing 40. The width of oil groove 72 in relation to journal bearing length L controls how much bearing contact area is available to carry the radial load. Experimentation has shown that a currently preferred range of the ratio L/D may be between about 0.25 and about 0.40, and that a currently preferred range of the ratio W/L may be between about 0.15 and about 0.70.

Oil provided by engine 18 is supplied to oil groove 72 by one or more oil passages 74 that extend radially from output hub axial bore 56 of output hub 20 to oil groove 72. Filter 60 filters contaminants from the incoming oil before entering oil passages 74. Filter 60 also filters contaminants from the incoming oil before being supplied to harmonic gear drive unit 12 and bearing 46. Filter 60 is a band-type filter that may be a screen or mesh and may be made from any number of different materials that are known in the art of oil filtering.

Extension portion 82 of output hub 20 receives bushing 78 in a press fit manner. In this way, output hub 20 is fixed to bushing 78. Input sprocket axial bore 76 interfaces in a sliding fit manner with bushing 78 to form second journal bearing 84. This provides support for the radial drive load placed on input sprocket 16 and prevents the radial drive load from tipping first journal bearing 70 which could cause binding and wear issues for first journal bearing 70. Bushing 78 includes radial flange 80 which serves to axially retain back plate 66/input sprocket 16. Alternatively, but not shown, bushing 78 may be eliminated and input sprocket axial bore 76 could interface in a sliding fit manner with extension portion 82 of output hub 20 to form second journal bearing 84 and thereby provide the support for the radial drive load placed on input sprocket 16. In this alternative, back plate 66/input sprocket 16 may be axially retained by a snap ring (not shown) received in a groove (not shown) of extension portion 82.

Figure 5:
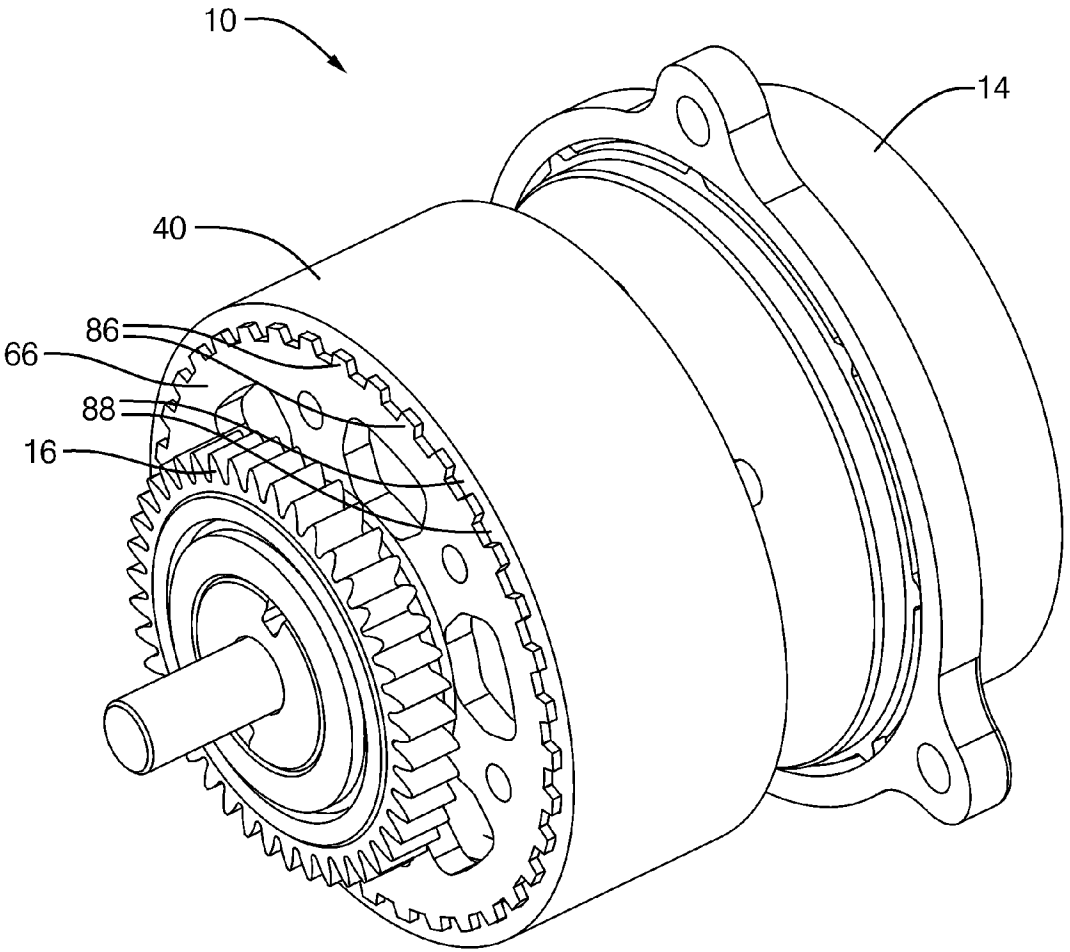
FIG. 5 is an isometric view of an eVCP in accordance with the present invention.

In order to transmit torque from input sprocket 16/back plate 66 to sprocket housing 40 and referring to FIGS. 1, 2, and 5, a sleeve gear type joint is used in which back plate 66 includes external splines 86 which slidingly fit with internal splines 88 included within sprocket housing 40. The sliding fit nature of the splines 86, 88 eliminates or significantly reduces the radial tolerance stack issue between first journal bearing 70 and second journal bearing 84 because the two journal bearings 70, 84 operate independently and do not transfer load from one to the other. If this tolerance stack issue were not resolved, manufacture of the two journal bearings would be prohibitive in mass production because of component size and concentricity tolerances that would need to be maintained. The sleeve gear arrangement also eliminates then need for a bolted flange arrangement to rotationally fix back plate 66 to sprocket housing 40 which minimizes size and mass. Additionally, splines 86, 88 lend themselves to fabrication methods where they can be net formed onto back plate 66 and into sprocket housing 40 respectively. Splines 86, 88 may be made, for example, by powder metal process or by standard gear cutting methods.

Figure 3:
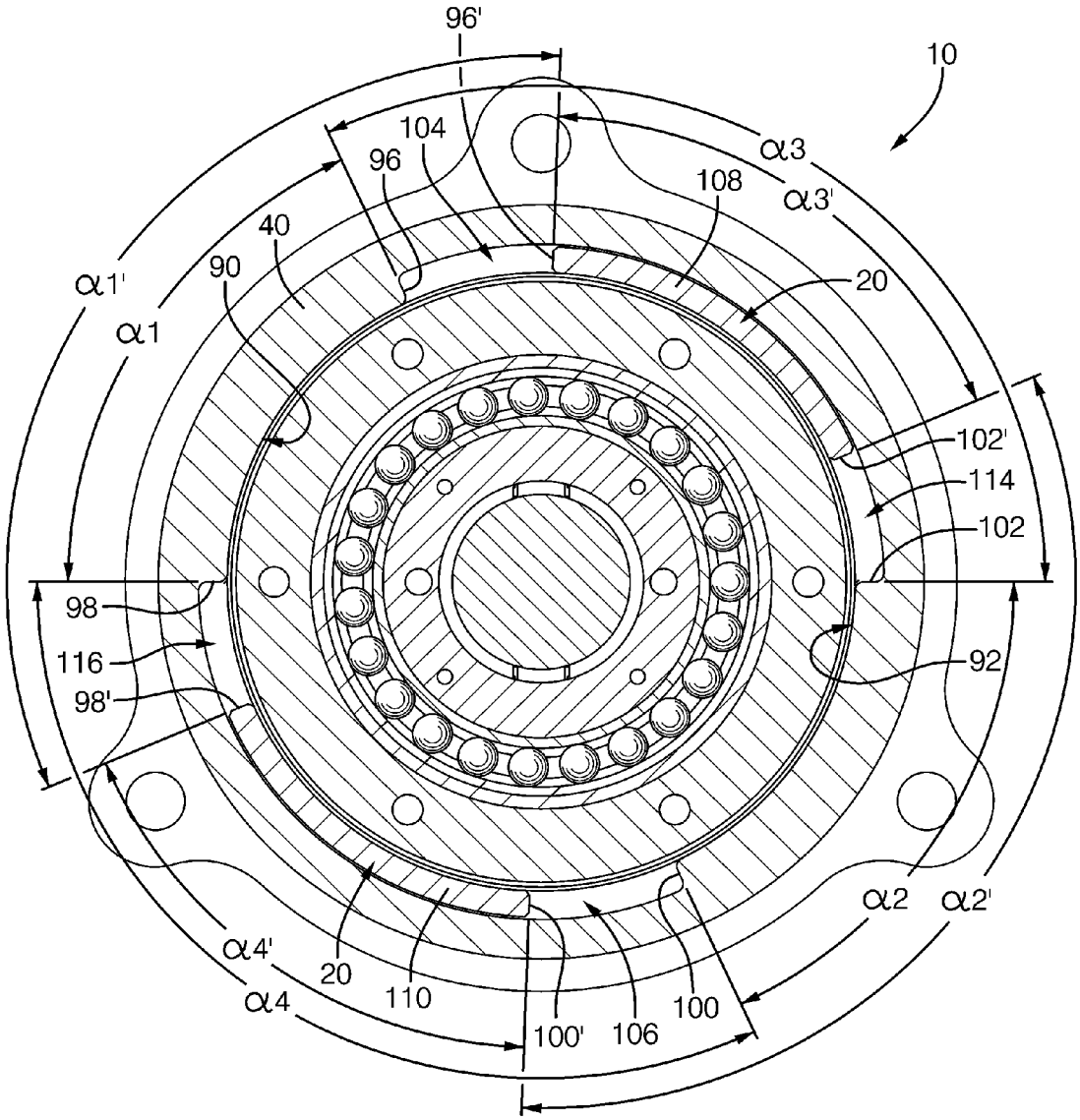
FIG. 3 is a radial cross-section through line 3-3 of FIG. 2.
Figure 4:
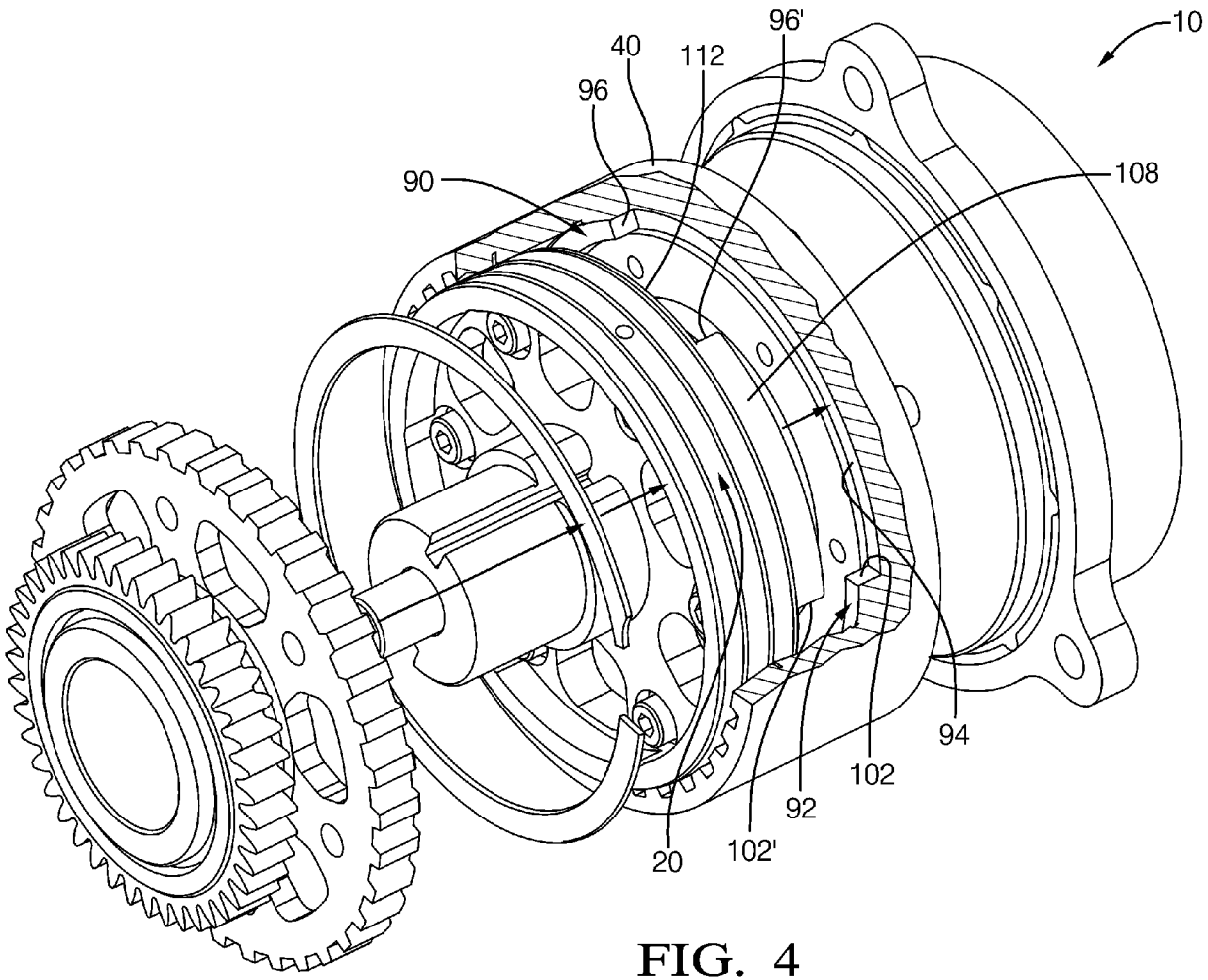
FIG. 4 is an exploded isometric partial cut-away view of an eVCP in accordance with the present invention.

Now referring to FIGS. 3 and 4, eVCP 10 is provided with a means for limiting the phase authority of eVCP 10. Sprocket housing 40 is provided with first and second arcuate input stop members 90, 92 which extend axially away from first surface 94 (also shown in FIG. 2) of sprocket housing 40, the first and second lengths of which are defined by the arcuate or angular distances $\alpha 1$, $\alpha 2$ respectively. First surface 94 is the bottom of the longitudinal bore which receives output hub 20 within sprocket housing 40. First arcuate input stop member 90 includes first advance stop surface 96 and first retard stop surface 98 which define the ends of first arcuate input stop member 90. Similarly, second arcuate input stop member 92 includes second advance stop surface 100 and second retard stop surface 102 which define the ends of second arcuate input stop member 92. First arcuate input opening 104 is defined between first advance stop surface 96 of first arcuate input stop member 90 and second retard stop surface 102 of second arcuate input stop member 92. First arcuate input opening 104 has a third length defined by the arcuate or angular distance $\alpha 3$. Similarly, second arcuate input opening 106 is defined between first retard stop surface 98 of first arcuate input stop member 90 and second advance stop surface 100 of second arcuate input stop member 92. Second arcuate input opening 106 has a fourth length defined by the arcuate or angular distance $\alpha 4$.

Now referring to FIGS. 1, 3, and 4, output hub 20 includes corresponding features which interact with first and second arcuate input stop members 90, 92 and first and second arcuate input openings 104, 106 to limit the phase authority of eVCP 10. Output hub 20 is provided with first and second arcuate output stop members 108, 110 which extend axially away from second surface 112 (also shown in FIG. 2) of output hub 20, the fifth and sixth lengths of which are defined by the arcuate or angular distances $\alpha 3'$, $\alpha 4'$ respectively. Second surface 112 is the end of output hub 20 which faces toward first surface 94. First arcuate output stop member 108 includes third advance stop surface 96' and fourth retard stop surface 102' which define the ends of first arcuate output stop member 108. Similarly, second arcuate output stop member 110 includes fourth advance stop surface 100' and third retard stop surface 98' which define the ends of second arcuate output stop member 110. First arcuate output opening 114 is defined between fourth retard stop surface 102' of first arcuate output stop member 108 and fourth advance stop surface 100' of second arcuate output stop member 110. First arcuate output opening 114 has a seventh length defined by the arcuate or angular distance $\alpha 2'$. Similarly, second arcuate output opening 116 is defined between third retard stop surface 98' of second arcuate output stop member 110 and third advance stop surface 96' of first arcuate output stop member 108. Second arcuate output opening 116 has an eighth length defined by the arcuate or angular distance $\alpha 1'$.

In order to establish the phase authority of eVCP 10, first and second arcuate input stop members 90, 92 are axially and radially received within second and first arcuate output openings 116, 114 respectively. Similarly, first and second arcuate output stop members 108, 110 are axially and radially received within first and second arcuate input openings 104, 106 respectively. The arcuate stop members and each corresponding arcuate opening within which the arcuate stop member is received are sized such that the angular distance of each angular opening minus the angular distance of the corresponding arcuate stop member is equal to the phase authority of eVCP 10. For example, angular distance $\alpha 1'$ minus angular distance $\alpha 1$ equals the phase authority of eVCP. Stated another way, if the phase authority for eVCP is 50 degrees, then angular distance $\alpha 1'$ (in degrees) minus angular distance $\alpha 1$ (in degrees) equals 50 degrees.

Angular distances $\alpha 1$, $\alpha 2$ of first and second arcuate input stop members 90, 92 are preferably equal and first and second arcuate input stop members 90, 92 are preferably angularly spaced in a symmetric manner. Similarly, angular distance $\alpha 3'$, $\alpha 4'$ of first and second arcuate output stop members 108, 110 are preferably equal and first and second arcuate output stop members 108, 110 are preferably angularly spaced in a symmetric manner. As can now be seen, distinct eVCPs can be provided for different engine application requiring different amounts of phase authority simply by redesigning the input stop members and the output stop members to achieve the desired phase authority.

Angular distances α3, α4 of first and second arcuate input openings 104, 106 are preferably equal and first and second arcuate input openings 104, 106 are preferably angularly spaced in a symmetric manner. Similarly, angular distance α1', α2' of first and second arcuate output openings 114, 116 are preferably equal and first and second arcuate output openings 114, 116 are preferably angularly spaced in a symmetric manner.

Figure 6:
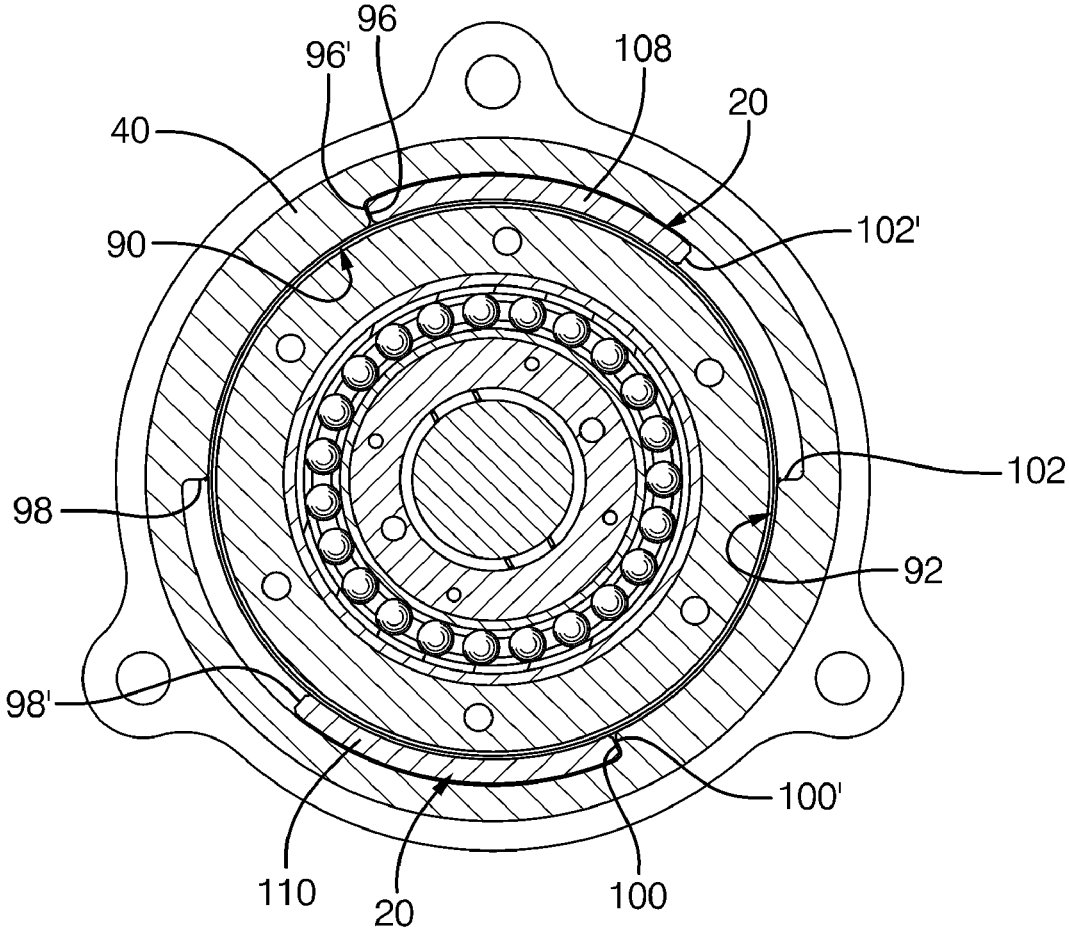
FIG. 6 is a radial cross-section as in FIG. 3 now shown in the maximum advance valve timing position.
Figure 7:
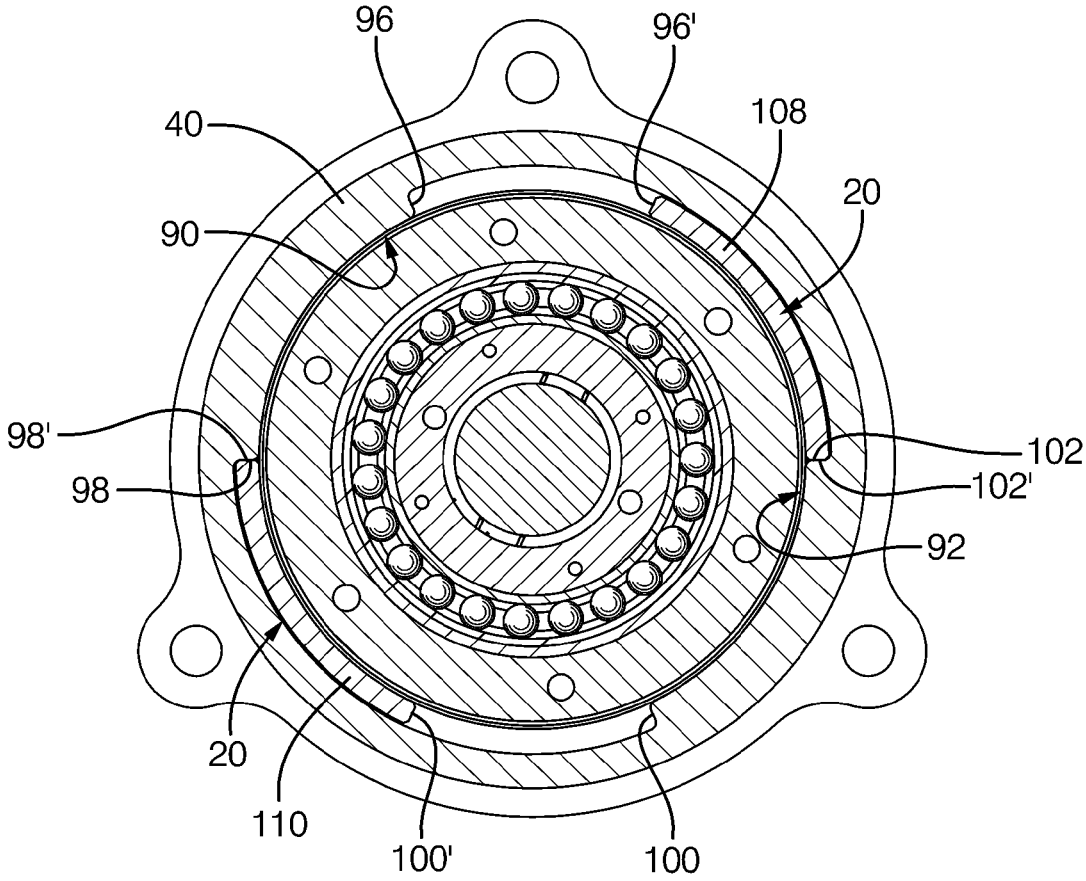
FIG. 7 is a radial cross-section as in FIG. 3, now shown in the maximum retard valve timing position.

In operation, when eVCP is commanded to provide maximum valve timing advance, electric motor 14 will actuate harmonic gear drive unit 12 to rotate output hub 20 with respect to sprocket housing 40 until first and third advance stop surfaces 96, 96' are in contact with each other (FIG. 6). At the same time, second and fourth advance stop surfaces 100, 100' are in contact with each other. Similarly, when eVCP is commanded to provide maximum valve timing retard, electric motor 14 will actuate harmonic gear drive unit 12 to rotate output hub 20 with respect to sprocket housing 40 until second and fourth retard surfaces 102, 102' are in contact with each other (FIG. 7). At the same time, first and third retard surfaces 98, 98' are in contact with each other.

While the embodiment described herein describes input sprocket 16 as being smaller in diameter than sprocket housing 40 and disposed axially behind sprocket housing 40, it should now be understood that the input sprocket may be radially surrounding the sprocket housing and axially aligned therewith. In this example, the back plate may be press fit into the sprocket housing rather than having a sleeve gear type joint.

While the embodiment described herein includes first and second input stop members, it should now be understood that more or fewer arcuate input stop members may be included. Similarly, more or fewer arcuate output stop members may be included.

While the embodiment described herein describes angular distances α1, α2 of first and second arcuate input stop members 90, 92 as equal and first and second arcuate input stop members 90, 92 are angularly spaced in a symmetric manner, it should now be understood that the first and second arcuate input stop members may be have unequal lengths and may also be spaced asymmetrically. This will result in the first and second arcuate output members being unequal in length and being spaced asymmetrically.

The embodiment described herein describes harmonic gear drive unit 12 as comprising outer first spline 28 which may be either a circular spline or a dynamic spline which serves as the input member; an outer second spline 30 which is the opposite (dynamic or circular) of first spline 28 and which serves as the output member and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32. As described, harmonic gear drive unit 12 is a flat plate or pancake type harmonic gear drive unit as referred to in the art. However, it should now be understood that other types of harmonic gear drive units may be used in accordance with the present invention. For example, a cup type harmonic gear drive unit may be used. The cup type harmonic gear drive unit comprises a circular spline which serves as the input member; a flexspline which serves as the output member and which is disposed radially inwards of the circular spline and having outwardly-extending gear teeth disposed for engaging inwardly-extending gear teeth on the circular spline; and a wave generator disposed radially inwards of and engaging the flexspline.

While this invention has been described in terms of preferred embodiments thereof, it is not intended to be so limited, but rather only to the extent set forth in the claims that follow.

We claim:

1. A camshaft phaser for controllably varying the phase relationship between a crankshaft and a camshaft in an internal combustion engine, said camshaft phaser comprising:

a housing having a bore with a longitudinal axis;

a harmonic gear drive unit disposed radially within said housing, said harmonic gear drive unit comprising a circular spline and an axially adjacent dynamic spline, a flexspline disposed radially within said circular spline and said dynamic spline, a wave generator disposed radially within said flexspline, and a rotational actuator connectable to said wave generator, wherein one of said circular spline and said dynamic spline is fixed to said housing in order to prevent relative rotation therebetween;

a hub rotatably disposed radially within said housing axially adjacent to said harmonic gear drive unit and attachable to said camshaft and fixed to the other of said circular spline and said dynamic spline in order to prevent relative rotation therebetween;

a first advance stop surface fixed to a first surface and projecting axially from said first surface toward a second surface, wherein said first surface is rotatable with one of said circular spline and said dynamic spline and wherein said second surface is rotatable with the other of said circular spline and said dynamic spline;

a first retard stop surface fixed to said first surface and projecting axially from said first surface toward said second surface;

a second advance stop surface fixed to said second surface and projecting axially from said second surface toward said first surface; and a second retard stop surface fixed to said second surface and projecting axially from said second surface toward said first surface;

wherein said first and second advance stop surfaces overlap axially and radially to limit angular travel between said circular spline and said dynamic spline when said camshaft phaser is phasing said camshaft in the advance direction, and wherein said first and second retard stop surfaces overlap axially and radially to limit angular travel between said circular spline and said dynamic spline when said camshaft phaser is phasing said camshaft in the advance direction.

2. A camshaft phaser as in claim 1 further comprising:

a third advance stop surface fixed to said first surface and projecting axially from said first surface toward said second surface;

a third retard stop surface fixed to said first surface and projecting axially from said first surface toward said second surface;

a fourth advance stop surface fixed to said second surface and projecting axially from said second surface toward said first surface; and a fourth retard stop surface fixed to said second surface and projecting axially from said second surface toward said first surface;

wherein said third and fourth advance stop surfaces overlap axially and radially and act together with said first and said second advance stop surfaces to limit angular travel between said circular spline and said dynamic spline when said camshaft phaser is phasing said camshaft in the advance direction, and wherein said third and fourth retard stop surfaces overlap axially and radially and act together with said first and said second retard stop surfaces to limit angular travel between said circular spline and said dynamic spline when said camshaft phaser is phasing said camshaft in the retard direction.

3. A camshaft phaser as in claim 2 wherein:

said first advance stop surface and said third retard stop surface are opposite ends of a first stop member;

said second advance stop surface and said second retard stop surface are opposite ends of a second stop member;

said third advance stop surface and said first retard surface are opposite ends of a third stop member; and said fourth advance stop surface and said fourth retard stop surface are opposite ends of a fourth stop member.

4. A camshaft phaser as in claim 3 wherein said first and third stop members are made of unitary construction with said first member.

5. A camshaft phaser as in claim 3 wherein said second and fourth stop members are made of unitary construction with said second member.

6. A camshaft phaser as in claim 3 wherein said stop members are disposed within said longitudinal bore.

7. A camshaft phaser as in claim 3 wherein said stop members are disposed radially outward from said harmonic drive gear unit.

8. A camshaft phaser as in claim 2 wherein said first surface is a surface of said housing.

9. A camshaft phaser as in claim 2 wherein said second surfaced is a surface of said hub.

10. A camshaft phaser as in claim 3 wherein said second stop member is disposed between said first advance stop surface and said first retard stop surface and said fourth stop member is disposed between said third advance stop surface and said third retard stop surface.

11. A camshaft phaser as in claim 3 wherein said stop members are arcuate in shape.

12. A camshaft phaser for controllably varying the phase relationship between a crankshaft and a camshaft in an internal combustion engine, said camshaft phaser comprising:

a housing having a bore with a longitudinal axis;

a harmonic gear drive unit disposed radially within said housing, said harmonic gear drive unit including an input member, an output member, a wave generator disposed radially within said input member and said output member, and a rotational actuator connectable to said wave generator such that rotation of said wave generator causes relative rotation between said input member and said output member, wherein one of said input member and said output member is fixed to said housing in order to prevent relative rotation therebetween;

a hub rotatably disposed radially within said housing axially adjacent to said harmonic gear drive unit and attachable to said camshaft and fixed to the other of said input member and said output member in order to prevent relative rotation therebetween; and a first advance stop surface fixed to a first surface and projecting axially from said first surface toward a second surface, wherein said first surface is rotatable with one of said input member and said output member and wherein said second surface is rotatable with the other of said input member and said output member;

a first retard stop surface fixed to said first surface and projecting axially from said first surface toward said second surface;

a second advance stop surface fixed to said second surface and projecting axially from said second surface toward said first surface; and a second retard stop surface fixed to said second surface and projecting axially from said second surface toward said first surface;

wherein said first and second advance stop surfaces overlap axially and radially to limit angular travel between said input member and said output member when said camshaft phaser is phasing said camshaft in the advance direction, and wherein said first and second retard stop surfaces overlap axially and radially to limit angular travel between said input member and said output member when said camshaft phaser is phasing said camshaft in the advance direction.

13. A camshaft phaser as in claim 12 further comprising:

a third advance stop surface fixed to said first surface and projecting axially from said first surface toward said second surface;

a third retard stop surface fixed to said first surface and projecting axially from said first surface toward said second surface;

a fourth advance stop surface fixed to said second surface and projecting axially from said second surface toward said first surface; and a fourth retard stop surface fixed to said second surface and projecting axially from said second surface toward said first surface;

wherein said third and fourth advance stop surfaces overlap axially and radially and act together with said first and said second advance stop surfaces to limit angular travel between said input member and said output member when said camshaft phaser is phasing said camshaft in the advance direction, and wherein said third and fourth retard stop surfaces overlap axially and radially and act together with said first and said second retard stop surfaces to limit angular travel between said input member and said output member when said camshaft phaser is phasing said camshaft in the retard direction.

14. A camshaft phaser as in claim 13 wherein:

said first advance stop surface and said third retard stop surface are opposite ends of a first stop member;

said second advance stop surface and said second retard stop surface are opposite ends of a second stop member;

said third advance stop surface and said first retard surface are opposite ends of a third stop member; and said fourth advance stop surface and said fourth retard stop surface are opposite ends of a fourth stop member.

15. A camshaft phaser as in claim 14 wherein said first and third stop members are made of unitary construction with said first member.

16. A camshaft phaser as in claim 14 wherein said second and fourth stop members are made of unitary construction with said second member.

17. A camshaft phaser as in claim 14 wherein said stop members are disposed within said longitudinal bore.

18. A camshaft phaser as in claim 14 wherein said stop members are disposed radially outward from said harmonic drive gear unit.

19. A camshaft phaser as in claim 13 wherein said first surface is a surface of said housing.

20. A camshaft phaser as in claim 13 wherein said second surfaced is a surface of said hub.

21. A camshaft phaser as in claim 14 wherein said second stop member is disposed between said first advance stop surface and said first retard stop surface and said fourth stop member is disposed between said third advance stop surface and said third retard stop surface.

22. A camshaft phaser as in claim 14 wherein said stop members are arcuate in shape.

23. A camshaft phaser for controllably varying the phase relationship between a crankshaft and a camshaft in an internal combustion engine, said camshaft phaser comprising:

a housing having a bore with a longitudinal axis;

a harmonic gear drive unit disposed radially within said housing, said harmonic gear drive unit comprising a circular spline and an axially adjacent dynamic spline, a flexspline disposed radially within said circular spline and said dynamic spline, a wave generator disposed radially within said flexspline, and a rotational actuator connectable to said wave generator, wherein one of said circular spline and said dynamic spline is fixed to said housing in order to prevent relative rotation therebetween;

a hub rotatably disposed radially within said housing axially adjacent to said harmonic gear drive unit and attachable to said camshaft and fixed to the other of said circular spline and said dynamic spline in order to prevent relative rotation therebetween;

a first arcuate input stop member having a first length and rotatable with one of said circular spline and said dynamic spline; and a first arcuate output opening having a second length, said first arcuate output opening being defined by at least a first arcuate output stop member having a third length, said first arcuate output opening and said first arcuate output stop member being rotatable with the other of said circular spline and said dynamic spline;

wherein said first arcuate input stop member is received within said first arcuate output opening and said first length of said first arcuate input stop member is less than said second length of said first arcuate output opening to establish a predetermined phase authority of said camshaft phaser.

24. A camshaft phaser as in claim 23 further comprising:

a second arcuate input stop member having a fourth length and rotatable with said first arcuate input stop member; and a second arcuate output opening having a fifth length and defined by said first arcuate output stop member and a second arcuate output stop member having a sixth length, said second arcuate output opening and said second arcuate output stop member being rotatable with said first arcuate output opening;

wherein said second arcuate input stop member is received within said second arcuate output opening and said fourth length of said second arcuate input stop member is less than said fifth length of said second arcuate output opening in order to cooperate with said first arcuate input stop member and said first arcuate output opening to establish the predetermined phase authority of said camshaft phaser.

25. A camshaft phaser as in claim 24 wherein said first and second arcuate input stop members define a first arcuate input opening therebetween having a seventh length, wherein said first and second arcuate input sop members define a second arcuate input opening therebetween having an eighth length, and wherein said first arcuate output stop member is received within said first arcuate input opening and said second arcuate output stop member is received within said second arcuate input opening in order to cooperate with said first and second arcuate input stop members and said first and second arcuate output openings to establish the predetermined phase authority of said camshaft phaser.

* * * * *